United States Patent [19]

Keefer

[11] Patent Number: 4,599,947

[45] Date of Patent: Jul. 15, 1986

[54] RAILROAD CAR DIAPHRAGM

[75] Inventor: Ray A. Keefer, Akron, Ohio

[73] Assignee: The B. F. Goodrich Company, Akron, Ohio

[21] Appl. No.: 772,086

[22] Filed: Sep. 30, 1985

Related U.S. Application Data

[63] Continuation of Ser. No. 533,394, Sep. 19, 1983, abandoned.

[51] Int. Cl.[4] ..... B61D 17/22

[52] U.S. Cl. ..... 105/15; 105/20; 105/21

[58] Field of Search ..... 105/8 R, 15, 16, 17, 105/18, 20, 21, 22; 296/166

[56] References Cited

U.S. PATENT DOCUMENTS

| | | | |
|---|---|---|---|
| 2,563,411 | 8/1951 | Miller | 105/18 |
| 2,568,684 | 9/1951 | Mihalyi | 105/18 |
| 3,399,632 | 9/1968 | Dean | 105/15 |
| 3,410,226 | 11/1968 | Krupp | 105/18 X |
| 3,996,859 | 12/1976 | Heisler et al. | 105/15 |

*Primary Examiner*—Randolph A. Reese
*Assistant Examiner*—David F. Hubbuch
*Attorney, Agent, or Firm*—Joseph Januszkiewicz

[57] ABSTRACT

A railroad diaphragm comprising a mounting plate coupleable to the end face of a railroad car, a face plate and wear plate for contact to an adjacent diaphragm, and sheet material located therebetween. Sponge like material within the space between the mounting plate and sheet material at the upper section thereof, provides resilience to the diaphragm.

5 Claims, 8 Drawing Figures

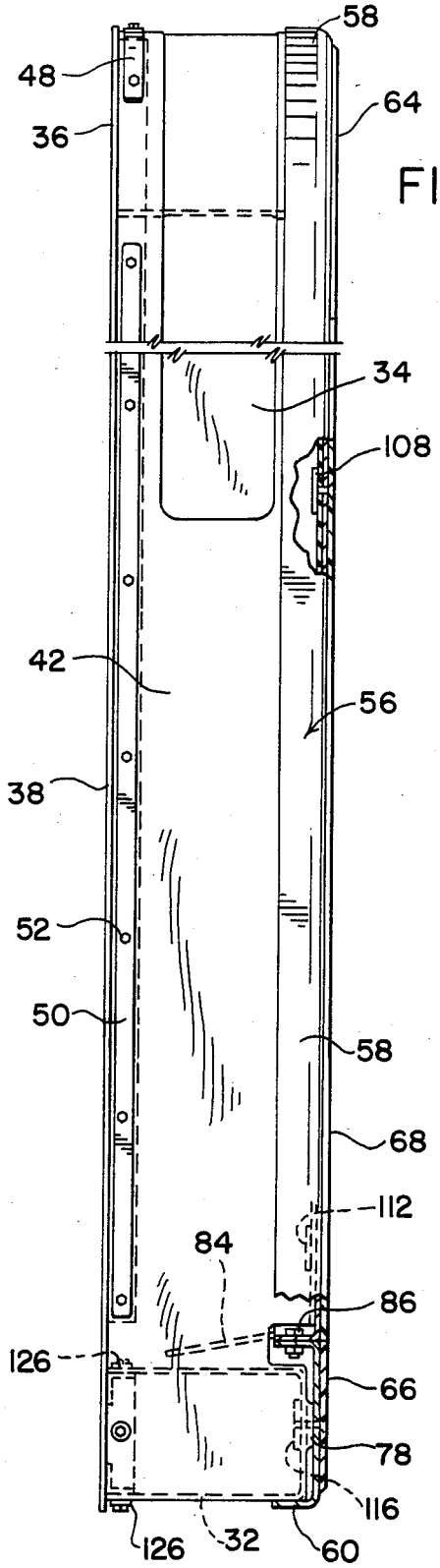
FIG. 4
FIG. 8
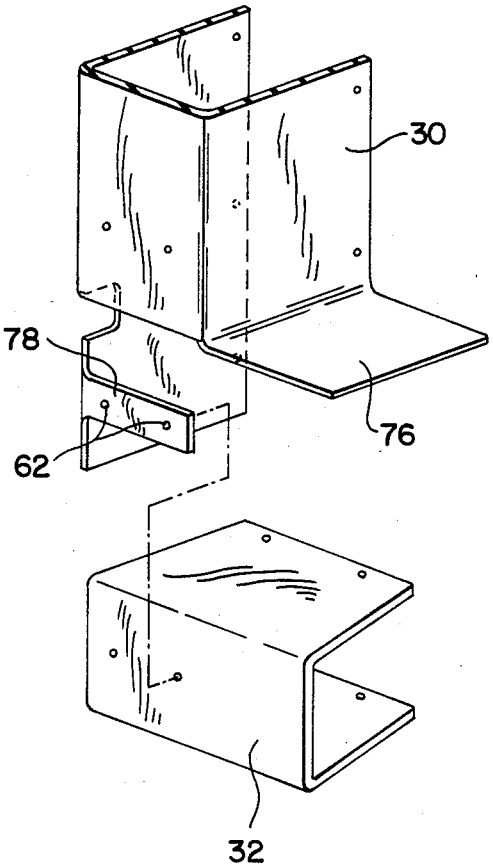

RAILROAD CAR DIAPHRAGM

This is a continuation of application Ser. No. 06/533,394, filed Sept. 19, 1983, now abandoned.

BACKGROUND OF THE INVENTION

This invention relates to flexible diaphragms for enclosing the space between adjoining ends of two railroad cars so as to provide a passageway between the cars being mated.

In the past, the need has been identified to encompass the space between adjacent railroad cars to permit the convenient movement of passengers therebetween. Prior art approaches to fulfill such need are described in U.S. Pat. No. 3,399,632 to Dean and in U.S. Pat. No. 3,410,226 to Krupp. According to such prior art disclosures, diaphragms are attached to the ends of adjacent cars and then the diaphragms are mated to each other to protect the space between adjacent railroad cars from the weather and noise while permitting the convenient movement of passengers therethrough. Such prior art approaches have traditionally entailed the usage of large, expensive structures with walls of solid resilient material coated with a sealing elastomer and contoured to permit expansion, contraction and torsional movement of the diaphragms with respect to each other and with respect to the cars during movement of the train. Such prior approaches were neither adequately efficient nor economical for their intended purpose.

Such prior art approaches to the problem were characterized by high initial cost of construction as well as high costs for refurbishment. The turn-around time for refurbishment was consistently too lengthy, with the cost and labor to replace such a diaphragm being excessive. Further, the prior art constructions required replacement of the entire diaphragm in the event of significant damage to any part thereof.

SUMMARY OF THE INVENTION

The railroad car diaphragm, constructed according to the present invention, overcomes the aforementioned deficiencies in the prior art. It is characterized by a thin rubber sheet, in an arch-like configuration. The sheet is arranged to couple an interior mounting plate, mountable to a train car, and an exterior face plate, which mates with a diaphragm on an adjacent car. A wear plate is located on the exterior surface of each face plate. A removeable section of resilient material is provided across the top of the arch of the diaphragm within the confines of the sheet material and mounting plate to assist in the resilient characteristics of the diaphragm during operation. The wear plate of each diaphragm is mated with the wear plate of the next adjacent diaphragm to complete the passageway between cars. Step plates are also provided over which pedestrians may walk when passing through the diaphragm from car to car.

The diaphragm is designed for attachment to the vertical end wall of a railroad car at its mounting plate and encloses a doorway into the car. It extends axially toward the corresponding mating doorway of the next adjoining car. In its axial extent the body is designed to mate axially with the corresponding diaphragm on the adjoining car with some compression and pressure on the diaphragm when the cars are normally coupled. These mating diaphragms thus cooperate to provide a passageway between adjoining cars above the normal car coupling.

The construction of the diaphragm is such that its body portion at the sill of the doorway provides a step plate or walkway between adjoining cars without the necessity for the use of other independent plates or structures.

The diaphragm further includes resilient shear mount type spring cushions to provide support for the diaphragm as well as resistance to vertical and horizontal displacement of the diaphragm resulting from either persons walking on the floor of the diaphragm or from the adjacent railway cars moving uphill, downhill or sideways.

The materials and constructions employed further act as an excellent sound absorber and thermal insulator to thereby reduce the possibility of undesirable noise and external weather conditions inconveniencing passengers in the diaphragm or at the ends of adjoined railway cars.

The axial compression characteristics of these diaphragms assure that the mating wear plates remain in contact under most conditions including the periods when the train is rounding sharp curves, thereby preventing weather leaks and air noises at the mating faces of the diaphragms.

The vertical rubber supports in the diaphragm provide a high resistance to vertical deflection without imparing the axial flexibility of the diaphragms. These vertical supports also provide flexibility to the diaphragm walls when the train is rounding a curve.

Moreover these diaphragms provide a smooth cosmetic appearance, which is applicable to both the interior of the diaphragm passageway and the exterior of the diaphragm. The exterior appearance features of the diaphragm provide compatability with the streamlined design of the exterior of modern trains.

Perhaps, most importantly, the specific designs and constructions of the present invention provide for modularity of the various components to minimize construction, mounting, repair and refurbishing activities in terms of time, cost, labor and parts. The initial cost of construction and mounting is reduced and the customer can now, due to the modularity of the diaphragm, repair worn or damaged parts without replacing the entire assembly.

Consequently, it is an object of the present invention to provide a modular diaphragm for adjacent railroad cars which are more efficient and more economical than prior art structures.

DESCRIPTION OF THE DRAWINGS

The following description and drawings illustrate a preferred embodiment of this present invention.

In the drawings:

FIG. 4 is a side elevational view of the diaphragm as shown in FIG. 3 taken along line 4—4 of FIG. 3 but with areas removed to show certain internal constructions.

FIG. 8 is an exploded perspective view of the lower portion of the vertical sheet material showing the coupling with the lower horizontal sheet material pieces.

DETAILED DESCRIPTION OF THE INVENTION

Figure 1:
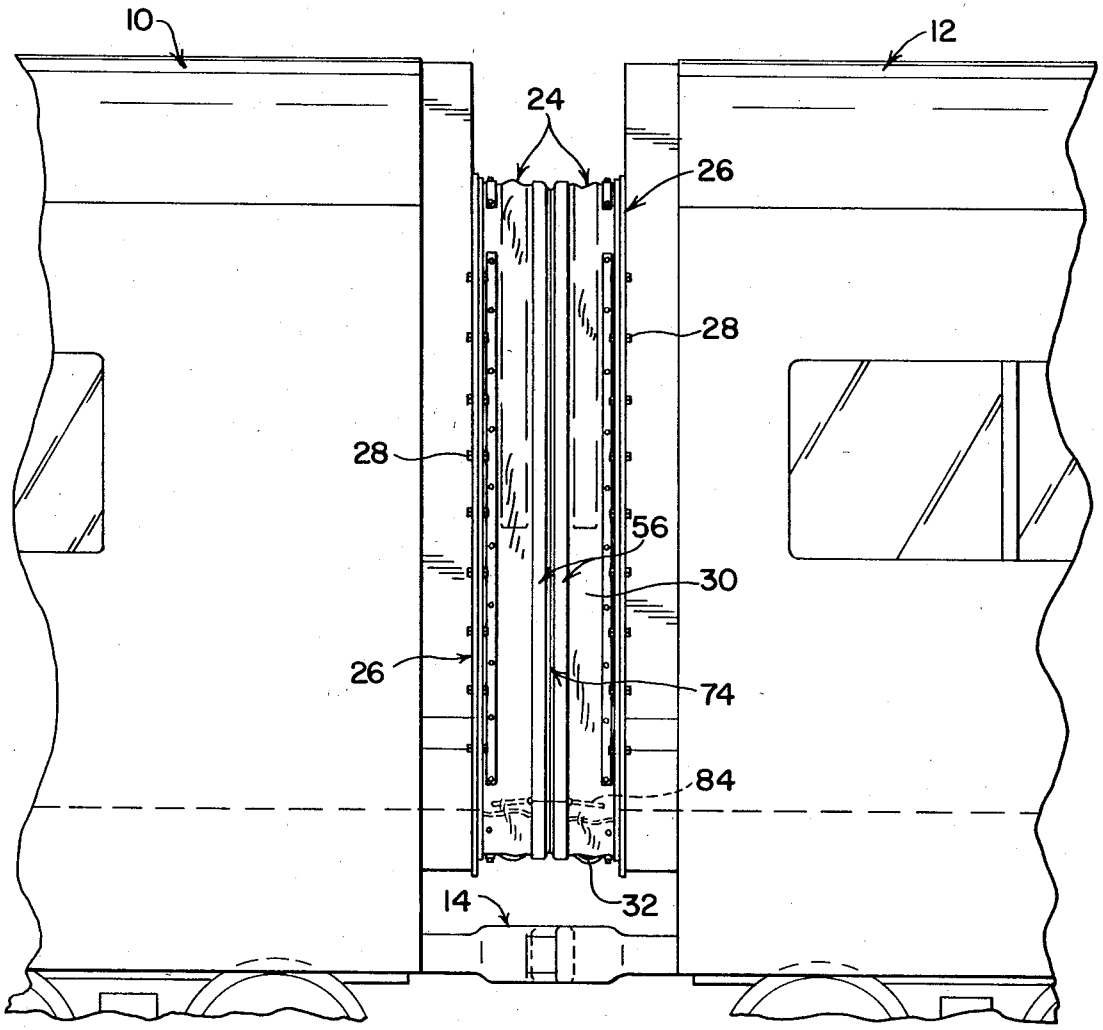
FIG. 1 is a side elevational view of adjacent railroad cars coupled together, each car employing a diaphragm constructed in accordance with the principles of the present invention.

Shown in FIG. 1 are a pair of railroad cars 10 and 12 mounted and mated together by the conventional coupling means 14. The cars are mounted for movement on wheels along a track, again in the conventional fashion.

Each railway car terminates with a passageway 18 for the movement of pedestrians therethrough. The passageway is surrounded by an attached reinforced apertured end wall 20. To this end wall is mounted the diaphragm 24 through a mounting plate 26. The mounting plate is located at the outboard end of each railway car which constitutes the inboard end of each diaphragm. Each mounting plate and end wall of the car have mating bolt holes to permit the attachment of the mounting plate of the diaphragm to the end wall of each car through suitable bolts 28. The end wall and mounting plate are made of appropriate wear resistant rigid metal materials.

The mounting plate is made up of sections having an upper arched portion 36 and vertical side portions 38 and 40 which are welded as a unit.

Next exterior from the mounting plate are the rubber diaphragm sections of sheet material. The rubber diaphragm sheets 42 are flexible and consist of a neoprene compound about $\frac{1}{4}$ inch in thickness. The construction is reinforced in the center with a high tensile nylon fabric. The neoprene compound has good flame resistant characteristics and meets the Rohr Specification S 80000 Group III sheeting material for intercar closures.

The major portion of the body of the diaphragm is made up of this flexible sheet material. These flexible portions couple the interior mounting plate with the exterior face plate. A polyurethane sponge segment is inserted across the top of the arch like diaphragm in a manner to be later described. The body is particularly designed to accommodate a high degree of axial compression. The interior and exterior of the body of the diaphragm is capable of substantial, for example, over 50 percent overall axial deformation without substantial distortion of the interior, exterior wall surfaces. The upper corners of the sheet are formed with grooves 34 to facilitate the bending action.

Figure 2:
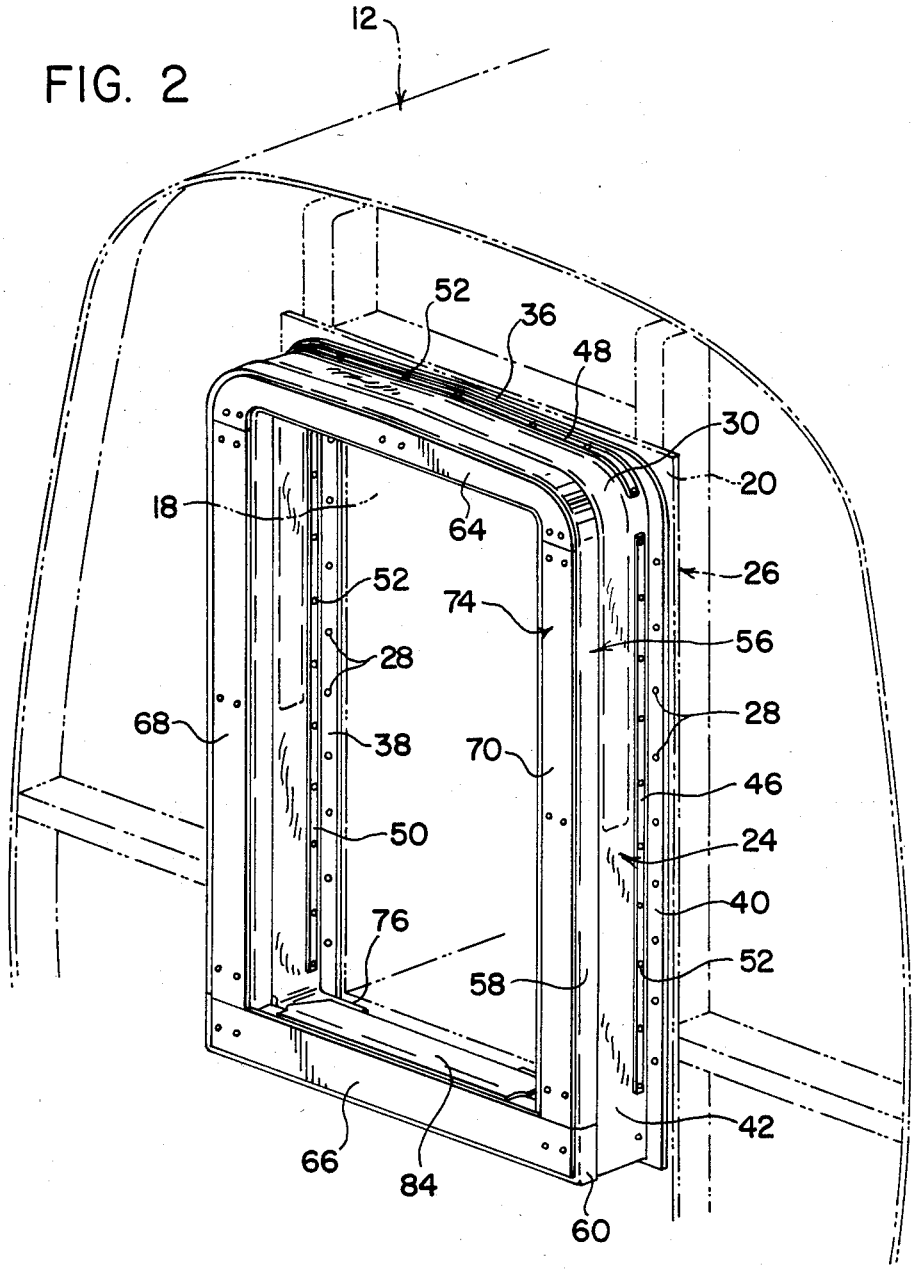
FIG. 2 is a partial perspective view of a railroad car having a diaphragm attached to one vertical end of the car with the railroad car shown in phantom lines.

Extending parallel with, and to the same extent as, the mounting plate is an aluminum flange 44 for securing the sheets to the mounting plate. The flange is riveted to the mounting plate. Apertured retainer strips 46, 48, 50, 51 and 126 accept bolts 52 for attachment to the flange with the sheets therebetween. Although only three retaining strips are shown in FIG. 2 and three in FIG. 5, a total of ten are utilized. Two interior and two exterior along the vertical extents of the sheet material and one interior and one exterior of the top horizontal extent and four on the lower horizontal sections.

Figure 6:
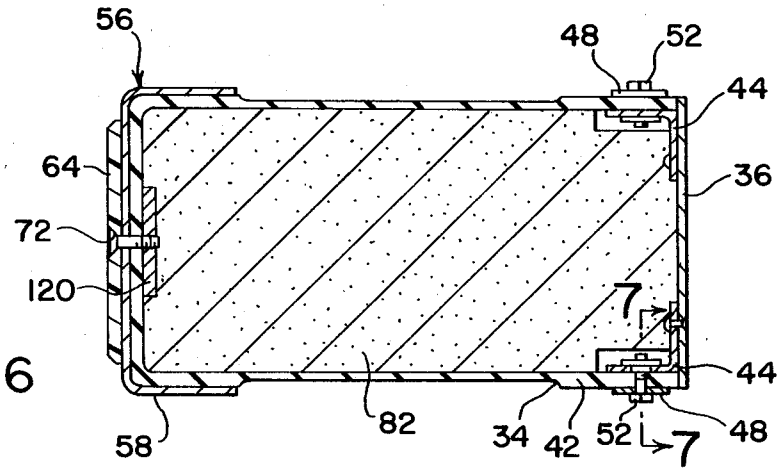
FIG. 6 is a sectional view through the top of the diaphragm taken along line 6—6 of FIG. 3.
Figure 7:
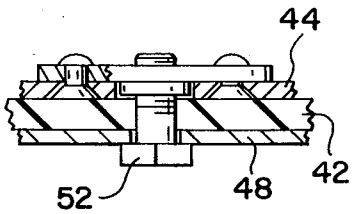
FIG. 7 is a detailed view of a bolt assembly taken along line 7—7 of FIG. 6.

The face plate 56 is located next outboard from the sheets. The face plate is made in two sections, an upper arch-shaped channel 58 and a lower channel 60, secured together by bolts 86 for ease of construction and replacement of damaged sections. Each flexible diaphragm section is U-shaped in configuration with two side portions and a bridging portion, the sides being connected to the mounting plate and the bridging portion secured to the face plate as described above (see FIG. 6).

Located below the joining area of the channel segments of the face plate are lower straight diaphragm sheet segments 32 in a horizontal disposition which couple with the lower ends of the vertical segments 42 of the arch-shaped diaphragm of sheet material.

FIG. 8 shows the coupling of the lower horizontal straight channeled sheets 32 in their U-shaped configuration which is coupled through bolts to the contoured lower segments 42 of upper sheet material through appropriate bolt holes 62.

Figure 3:
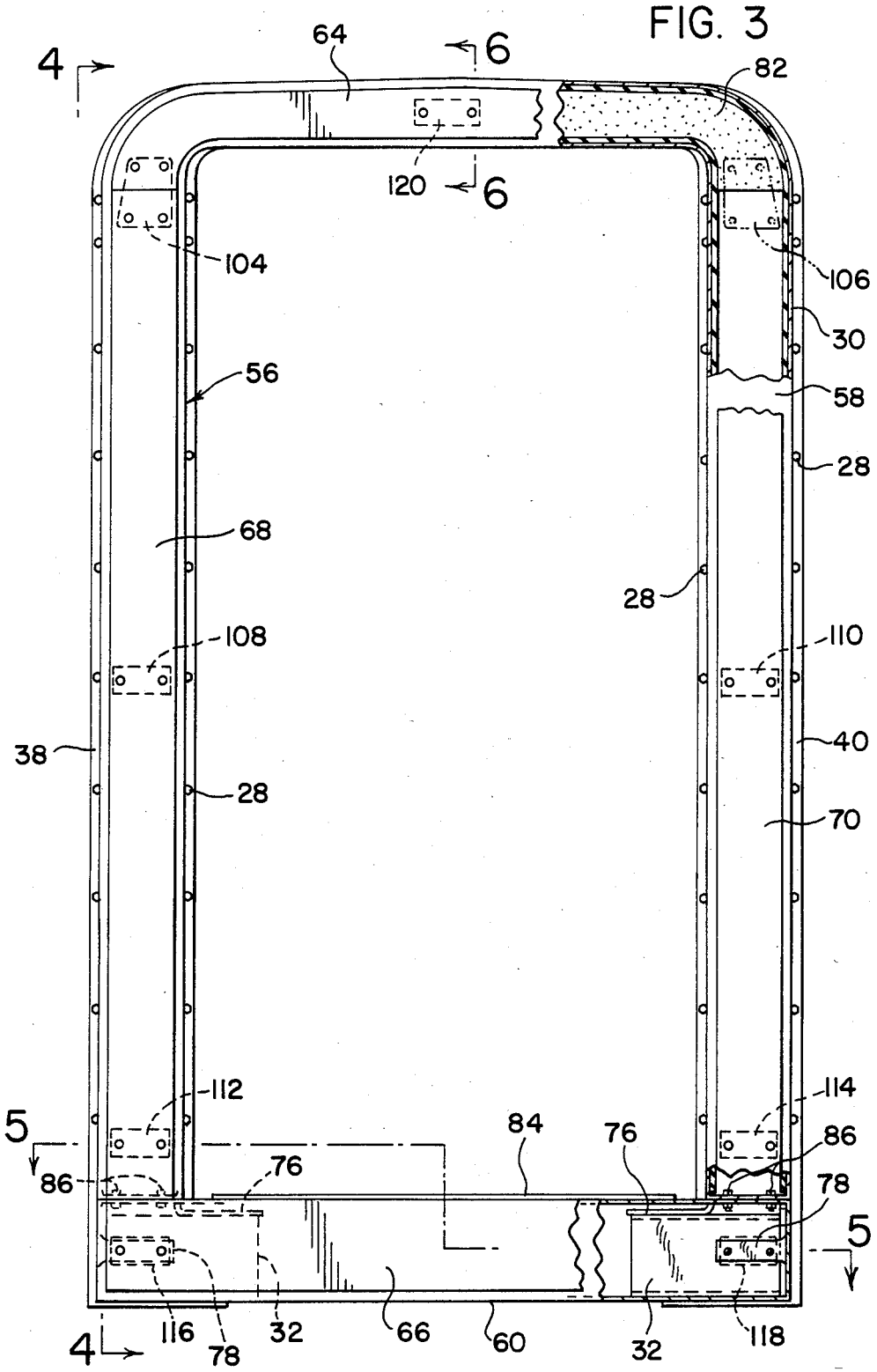
FIG. 3 is a front elevational view of the diaphragm assembly with sections removed to show internal constructions thereof.

The upper portion of FIG. 8 is the lower portion of the vertical segment of the sheet material and constitutes a vertical U-shaped channel with a horizontal surface 76 for mating with the upper portion of the lowermost horizontal segment of sheet material. A finger 78 horizontally extends inwardly for attachment through bolts to the central portion of the U-shaped lower sheet member. This Figure thus illustrates one corner of the attachment of the lower sheet material to an upper sheet material. A similar arrangement is on the opposite lower corner of the sheet material sections and is seen in FIG. 3.

Wear plate 74 covers the outboard surface of the face plate and is constructed of segments 64, 66, 68 and 70 which together match the surface shape of the face plate to which it is bonded and bolted. Bolt holes 72 are provided for coupling the wear plates to the face plate. The mating diaphragms, with the wear plates therebetween, are held in a highly compressed condition when coupled thereby reducing the possibility of external noises between abutting ends of the mating diaphragms.

The wear plate is constructed of a suitable smooth plastic material for contact and sliding with the wear plate of the next adjacent diaphragm for completing the passageway between cars.

Resilience is provided to each diaphragm through the use of resilience sponge material within the diaphragm across the top segment thereof. This sponge section 82 is removable during repair and refurbishing and is constructed preferably of a polyurethane sponge grade UU-44 fire retardant type material. The sponge is not sprayed and it is not bonded to the rubber or metal constructions. The sponge section is completely covered and enclosed by the mounting plate and the neoprene rubber diaphragm sheet construction. Its purpose is to provide resilience to the upper diaphragm corners.

Also located within each diaphragm is a step plate 84. Each step plate is constructed of a rigid material such as stainless steel and is welded to the lower face plate. The outboard ends of the step plate are tapered so as not to interfere with the car construction as the diaphragm moves with respect to the train during operation.

Figure 5:
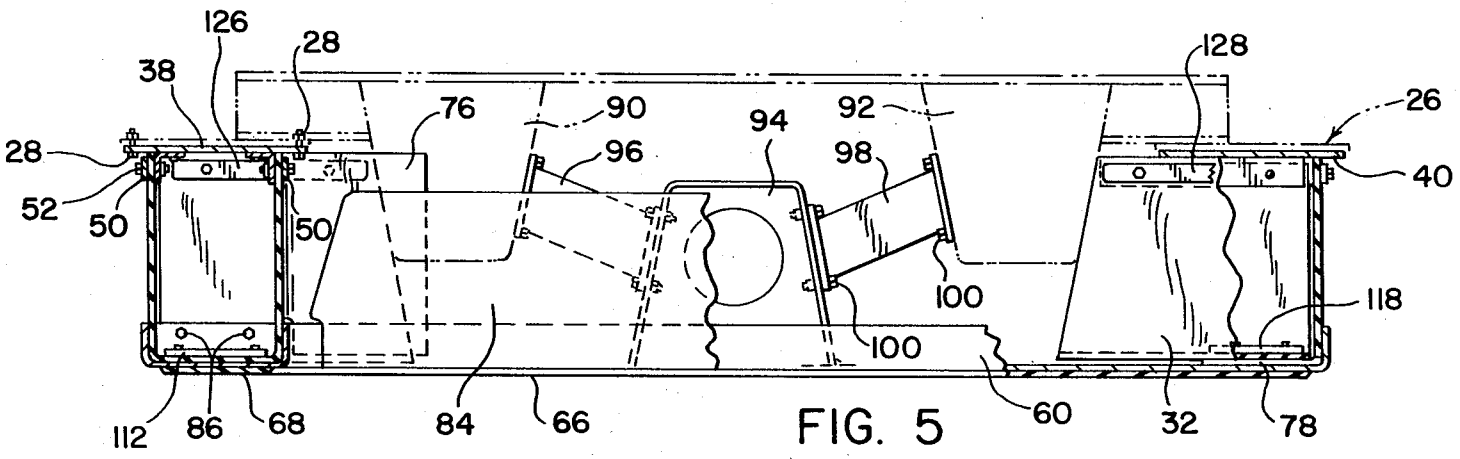
FIG. 5 is a sectional view of the lower portion of the face plate taken along line 5—5 of FIG. 3, again with parts removed to show certain internal constructions.

Shown in FIG. 5 is the attachment between the end plate of the car and the lower horizontal outboard portion of the face plate. The end plate of the car is provided with outwardly extending steel, truncated support assemblies 90 and 92 located adjacent to an inwardly extending stainless steel, truncated support assembly 94 secured as through welding to the lower horizontal segment of the diaphragm face plate. These assemblies are coupled one to another through shear mounts 96 and 98 of highly vulcanized rubber to effectively provide the horizontal support for the face plate and hence the entire diaphragm with respect to the car. The buffer plates are secured by bolts 100 at each respective end to the truncated support assemblies as shown for a secure coupling of the railway car to the diaphragm. The resilient shear mounts thus support the majority of the weight of the diaphragm when mounted on a car and provide additional security for passengers in motion between cars as they move through the diaphragm over the step plates.

Attachment plates 104, 106, 108, 110, 112, 114, 116, 118 and 120 are utilized inside the sheet material for support as shown in FIG. 3. These plates are bonded inside the rubber sheet and then bolted to the face plate and wear plate with the sheet material therebetween to provide support to the sheet material when in operative position. The upper corner plates 104 and 106 also span the sections of the wear plate. Lower plates 116 and 118 provide the support for the lower horizontal segments 32 of the sheet material.

While the present invention has been described above with regard to a particular preferred embodiment thereof, it will be readily apparent from this disclosure that variations from this preferred constructions may be made which will be within the spirit and scope of the appended claims.

What is claimed is:

1. A diaphragm for a railroad car comprising, a mounting plate secured to the end face of a railroad car, a plurality of flexible diaphragm sections in continuous alignment attached to said mounting plate, each of said flexible diaphragm sections being U-shaped in configuration with two side portions and a bridging portion, flange and retainer plates connecting said side portions to said mounting plate, a face plate exterior of said mounting plate secured to said bridging portion of said flexible diaphragm, a resilient sponge means located within said flexible diaphragm between said mounting plate and said face plate along the upper portion of said diaphragm for providing resilience to said diaphragm, said face plate is constructed of separable sections for access to said diaphragm sections, shear mounts of rubber coupling the lower portion of the face plate to said railroad car, and a wear plate covering the face of the face plate for contact with the adjacent car.

2. A diaphragm for a railway car comprising a mounting plate secured to the end face of a railway car defining a passageway into such car, said mounting plate is made up of a plurality of sections, a plurality of flexible diaphragm sections are connected to said mounting plate and extend outwardly therefrom, each of said flexible diaphragm sections have a pair of spaced side portions and a bridging portion defining a U-shaped configuration in cross-sections, said side portions of said flexible diaphragm sections are connected to said mounting plate by a series of flange and retainer strips to facilitate access to different portions of said diaphragm, said flexible diaphragm sections having an upper arched portion, a resilient sponge segment is mounted across said upper arched portion of said flexible diaphragm and in abutting contact with said mounting plate, said bridging portion of said diaphragm connected to at least a pair of flat rigid face plates, and a plurality of wear plates are secured to said face plates to provide access thereto and for contact with an adjacent diaphragm of an adjoining railway car.

3. A diaphragm for a railway car as set forth in claim 2 wherein said face plates are of general U-shaped configuration.

4. A diaphragm for a railway car as set forth in claim 3 wherein the lowermost section of said flexible diaphragm is a horizontally disposed section which has one of its side portions and bridging portion connected to spaced extensions of vertically extending diaphragm sections.

5. A diaphragm for a railway car as set forth in claim 4 wherein said wear plate is made from a smooth plastic material for sliding contact with an adjacent wear plate on an adjoining diaphragm of an adjoining railway car.

* * * * *